US010681958B2

(12) United States Patent
Toschi

(10) Patent No.: US 10,681,958 B2
(45) Date of Patent: Jun. 16, 2020

(54) ATHLETIC SHOE WITH POWER EXTENSION

(71) Applicant: Michael Toschi, Emerald Hills, CA (US)

(72) Inventor: Michael Toschi, Emerald Hills, CA (US)

( * ) Notice: Subject to any disclaimer, the term of this patent is extended or adjusted under 35 U.S.C. 154(b) by 0 days.

(21) Appl. No.: 14/746,476

(22) Filed: Jun. 22, 2015

(65) Prior Publication Data

US 2016/0366975 A1 Dec. 22, 2016

(51) Int. Cl.
*A43B 13/00* (2006.01)
*A43B 13/14* (2006.01)
*A43B 5/00* (2006.01)

(52) U.S. Cl.
CPC ..... *A43B 13/14* (2013.01); *A43B 5/001* (2013.01)

(58) Field of Classification Search
CPC ..... A43B 13/14; A43B 5/001; A43C 15/162
USPC ..... 36/127, 113, 103; 473/269
See application file for complete search history.

(56) References Cited

U.S. PATENT DOCUMENTS

| | | | | |
|---|---|---|---|---|
| 4,106,771 | A * | 8/1978 | Fern | 473/217 |
| 4,122,577 | A * | 10/1978 | Catania | 15/160 |
| 5,301,442 | A * | 4/1994 | Williams | 36/127 |
| RE37,887 | E * | 10/2002 | Yates | 36/133 |
| 7,228,649 | B2 * | 6/2007 | Elliott | A43B 1/0036 36/114 |
| 8,677,657 | B2 | 3/2014 | Bacon et al. | |
| 2007/0039210 | A1 * | 2/2007 | Clark et al. | 36/113 |

* cited by examiner

*Primary Examiner* — Timothy K Trieu
(74) *Attorney, Agent, or Firm* — Garlick & Markison; Timothy W. Markison

(57) ABSTRACT

An athletic shoe includes an upper section, a mid-sole, an outsole, and an extension. The outsole is coupled to the upper section and the mid-sole. The extension is coupled to the outsole and/or the mid-sole. The extension is on a medial side of the athletic shoe when worn on a dominant side and it extends from a toe section of the athletic shoe to a mid-foot section of the athletic shoe and, from a bottom perspective, extends beyond the upper section to provide an increase in force during performance of a rotational athletic task.

16 Claims, 14 Drawing Sheets front view - right foot
shoe 10 top view - right foot cross section front view - right foot pair of athletic shoes 25 bottom view of right shoe 10-1 bottom view of right shoe 10 front view - right foot shoe 10 front view - right foot shoe 10 front view - right foot shoe 10 front view - right foot shoe 10 front view - right foot shoe 10 front view - right foot shoe 10 pair of shoes 70 front view - left foot shoe 73 front view - right foot shoe 71 pair of shoes 70 front view - right foot shoe 10 front view - right foot shoe 10

ATHLETIC SHOE WITH POWER EXTENSION

CROSS REFERENCE TO RELATED PATENTS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

Technical Field of the Invention

This invention relates generally to athletic shoes and more particularly to an athletic shoe with a power extension.

Description of Related Art

Athletic shoes come in a wide variety of styles. For some athletic shoes, the style is primarily a function of fashion, weight, and/or comfort. For others, the style is primarily a function of a specific athletic activity. For example, golf shoes have a particular style to support the function of playing golf. As another example, running shoes have a particular style to support the function of running (e.g., sprinting or distance running). As yet another example, baseball shoes have a particular style to support the function of playing baseball.

Advancements in athletic shoe technology are increases as more is learned from a sports science standpoint regarding an athletic activity (e.g., golf, running, baseball, football, basketball, etc.). For instance, as more is learned about the biomechanics of a golf swing, golf shoe technology is advancing based on the increased learning to help golfers improve their play. Recent advances in golf shoe technology include a new outsole as described in issued U.S. Pat. No. 8,677,657. While athletic shoe technology is advancing, there is still significant room for further innovation to enhance quality and safety of athletic play.

BRIEF DESCRIPTION OF THE SEVERAL VIEWS OF THE DRAWING(S)

DETAILED DESCRIPTION OF THE INVENTION

Figure 1:
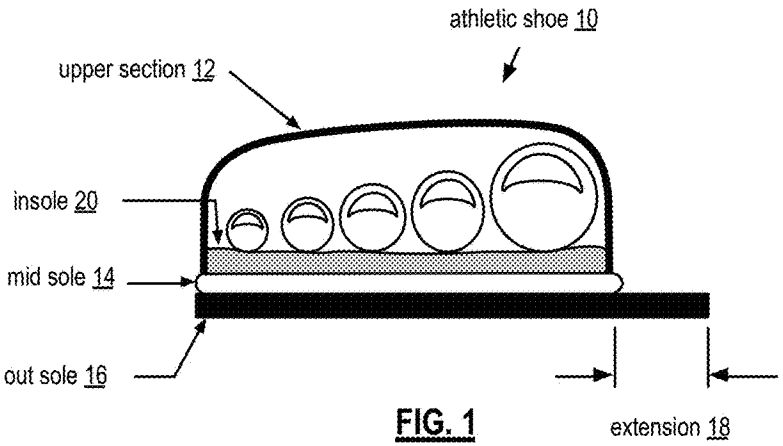
FIG. 1 is a cross-section front view of an embodiment of a right foot athletic shoe in accordance with the present invention.

FIG. 1 is a cross-section front view of an embodiment of a right foot athletic shoe 10 that includes an upper section 12, a midsole 14, an outsole 16, an extension 18, and an insole 20. An athlete may use the athletic shoe 10 on his/her dominant side foot (e.g., right foot for a right-handed athlete, left foot for a left-handed athlete) when he/she is participating in an athletic activity that includes a rotational athletic task. For example, the athlete shoe 10 may be a golf shoe, a baseball shoe, a track and field shoe (e.g., discus, etc.), a boxing shoe, etc.

The upper section 12 of the athletic shoe 10 may be constructed from a variety of materials (e.g., leather, vinyl, plastics, polymers, a mesh, and/or a synthetic material) in a variety of patterns depending on a desired look, comfort, weight, and/or fit. For example, for a golf shoe, the upper section 12 may be a low top shoe design made of leather. As another example, for a baseball shoe, the upper section 12 may be low, mid, or high top shoe design made of a combination of synthetic material and a mesh.

The midsole 14 lies between the outsole 16 and the insole 20 to provide one or more of weight distribution, stability of the foot, and shock absorption. The midsole 14 may be constructed from foam, plastic, and/or ethylene-vinyl acetate (EVA) and formed into a shape to provide the desired function of the midsole 14.

The outsole 16 is coupled to the upper section 12 in one or more ways (e.g., glued, stitched, riveted, etc.) and is coupled to the midsole 14 in one or more ways (e.g., gluing, molding, melding, and/or other fastening technique). The outsole 16 is constructed of rubber, polyurethane (PU), plastic, thermoplastic polyurethane (TPU), and/or a combination thereof and includes a sport specific pattern on the bottom to facilitated performance of an athletic task. For example, the outsole 16 of a golf shoe will include non-metal cleats to provide traction.

In an embodiment, the extension 18 is integrated into the outsole 16 and may be constructed from the same material as the outsole 16 and/or a different material (e.g., foam, plastic, ethylene-vinyl acetate (EVA), rubber, polyurethane (PU), plastic, thermoplastic polyurethane (TPU), and/or a combination thereof). The extension 18 may be constructed from one or more materials to provide a rigid structure, a semi-flexible (e.g., bend a degree to five or more degrees), a recoil mechanism (e.g., as force is applied, the extension coils and then recoils as the force is released), and/or a combination thereof.

Figure 2:
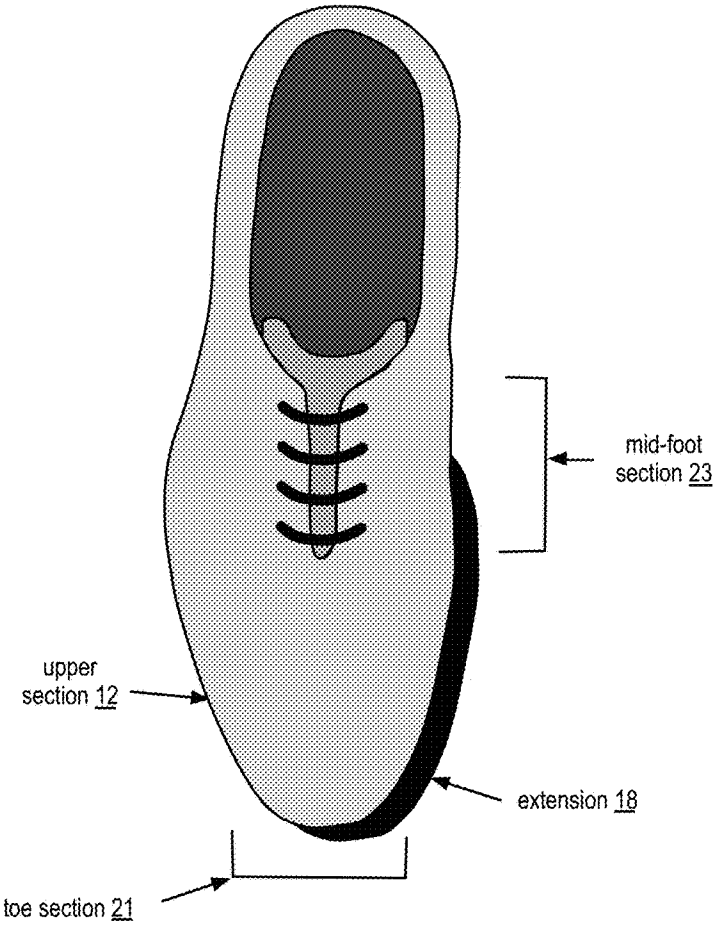
FIG. 2 is a top view of an embodiment of a right foot athletic shoe in accordance with the present invention.

The extension 18 is fabricated on a medial side of the athletic shoe 10 of a dominant side foot (e.g., right foot for a right-handed athlete, left foot for a left-handed athlete) to provide an increase in force during performance of a rotational athletic task. As shown in FIG. 2, the extension 18 extends from a toe section 21 (e.g., in a region starting somewhere between the little toe and the big toe) of the athletic shoe 10 to a mid-foot section 23 of the athletic shoe 10 (e.g., starting around the ball of the foot area extending towards the toe). In addition, the extension 18 extends, from a top perspective as is also shown in FIG. 2, beyond the upper section 12 by a desired distance (e.g., in the range of a few millimeters (mm) to 15 mm or more).

As an example, when the athletic shoe 10 is a golf shoe and is worn by a golfer during a golf swing, the extension 18 provides a wider base for the dominant leg foot and a wider pivot point, which effectively increases the power of the golf swing (i.e., with respect to the same golfer exerting the same effort wearing a conventional pair of golf shoes). As another example, when the athletic shoe 10 is a baseball shoe and is worn by a baseball player during a swing or throwing a baseball, the extension 18 provides a wider base for the dominant leg foot and a wider pivot point, which effectively increases the power of the swing or the throw.

Figure 3:
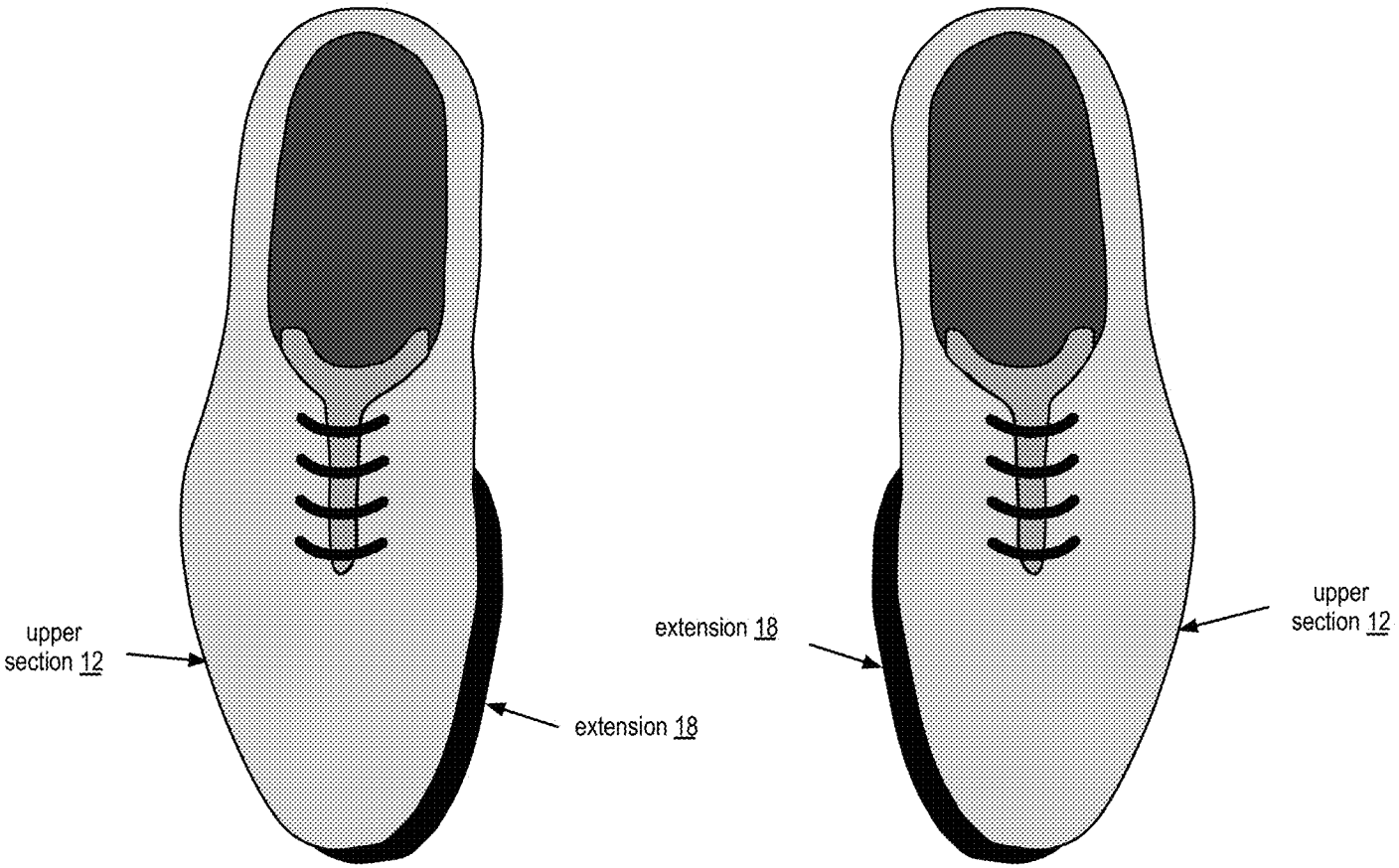
FIG. 3 is a top view of an embodiment of a pair of athletic shoes in accordance with the present invention.

FIG. 3 is a top view of an embodiment of a pair of athletic shoes 25 that includes a right foot shoe 27 and a left foot shoe 29. Both shoes include the upper section 12 and the extension 18 on the medial side of the respective shoe 27 or 29. The extensions 18 on each shoe may be the same size, shape, material, etc. or they may be different.

Figure 4:
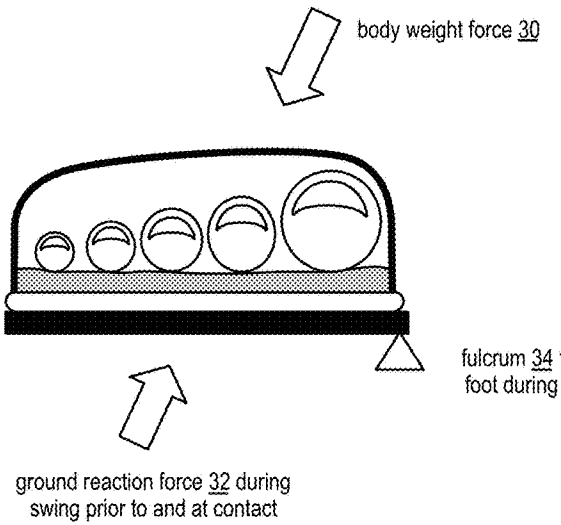
FIG. 4 is a cross-section front view of an example of forces of a conventional right-footed athletic shoe.

FIG. 4 is a cross-section front view of an example of forces of a conventional right-footed athletic shoe. During a rotational athletic task (e.g., swinging a golf club), the body applies a body weight force 30 on the dominant leg foot, which is met by an equal and opposite ground reaction force 32. At, or near, the point of contact for the rotational athletic task (e.g., hitting a golf ball), the dominant leg foot is pivoting along the medial edge of the forefoot. In essence, the medial edge of the forefoot of the shoe is functioning as a fulcrum 34 for the lever action of the dominant leg at, or near, the point of contact. During this action, the leverage of the dominant leg about the medial edge of the shoe creates an effective mass of the golfer. With force being a function of mass times acceleration, the more leverage action the golfer can achieve, the more effective mass he/she will have, resulting in more force during the swing.

Figure 5:
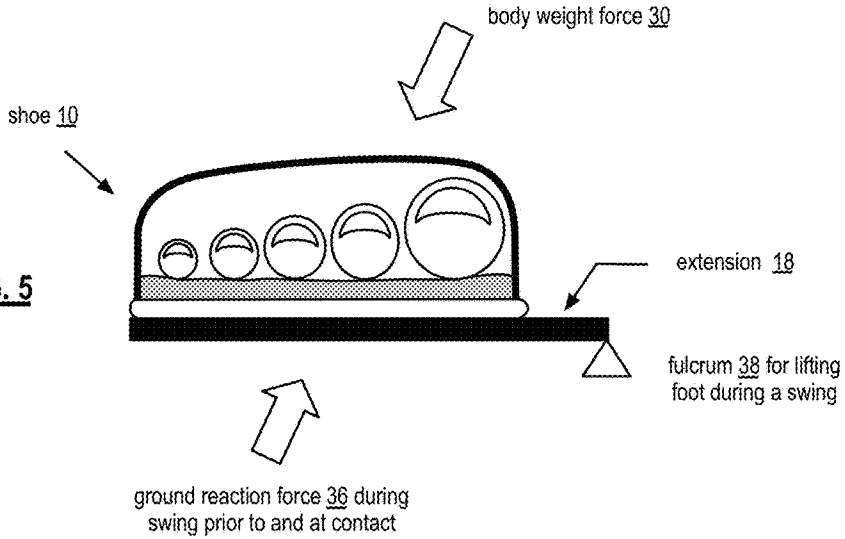
FIG. 5 is a cross-section front view of an example of forces of a right foot athletic shoe in accordance with the present invention.

FIG. 5 is a cross-section front view of an example of forces of a right-footed athletic shoe 10 that includes an extension 18. During a rotational athletic task (e.g., swinging a golf club), the body applies a body weight force 30 on the dominant leg foot, which is met by an equal and opposite ground reaction force 36. At, or near, the point of contact for the rotational athletic task (e.g., hitting a golf ball), the dominant leg foot is pivoting along the edge of the extension 18. In essence, the edge of the extension is functioning as a fulcrum 38 for the lever action of the dominant leg at, or near, the point of contact. During this action, the leverage of the dominant leg at the edge of the extension 18 (which extends beyond the medial edge of the conventional shoe by a few mm to 15 or more mm) creates a greater effective mass of the golfer than with the conventional golf shoe. With force being a function of mass times acceleration, the athletic shoe 10 with extension 18 creates more leverage action for the golfer with about the same effort, which creates more effective mass, resulting in more force during the swing.

Figure 6:
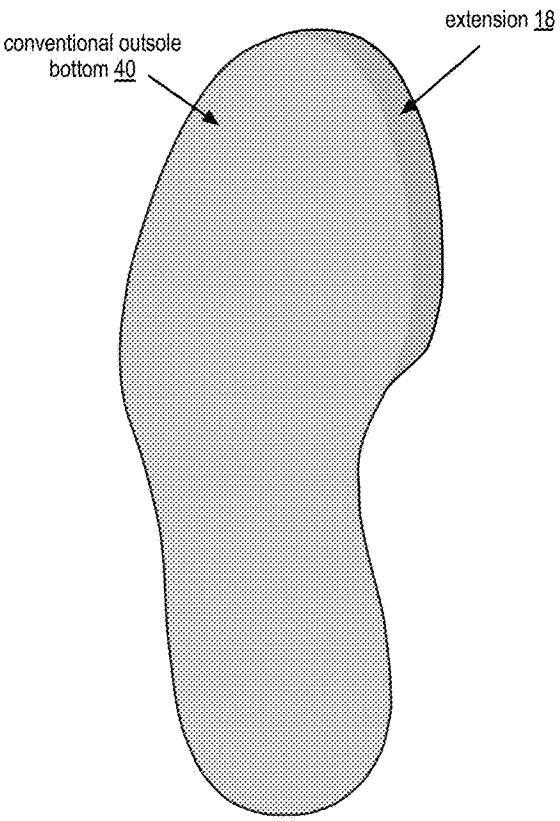
FIG. 6 is a bottom view of an embodiment of a right foot athletic shoe in accordance with the present invention.

FIG. 6 is a bottom view of an embodiment of a right-footed athletic shoe 10 that includes extension 18. To illustrate an example length and width of the extension 18, a conventional shoe bottom 40 is shown with light shading. In this embodiment, the extension 18 is one contiguous piece integrated into the outsole and/or the midsole.

Figure 7:
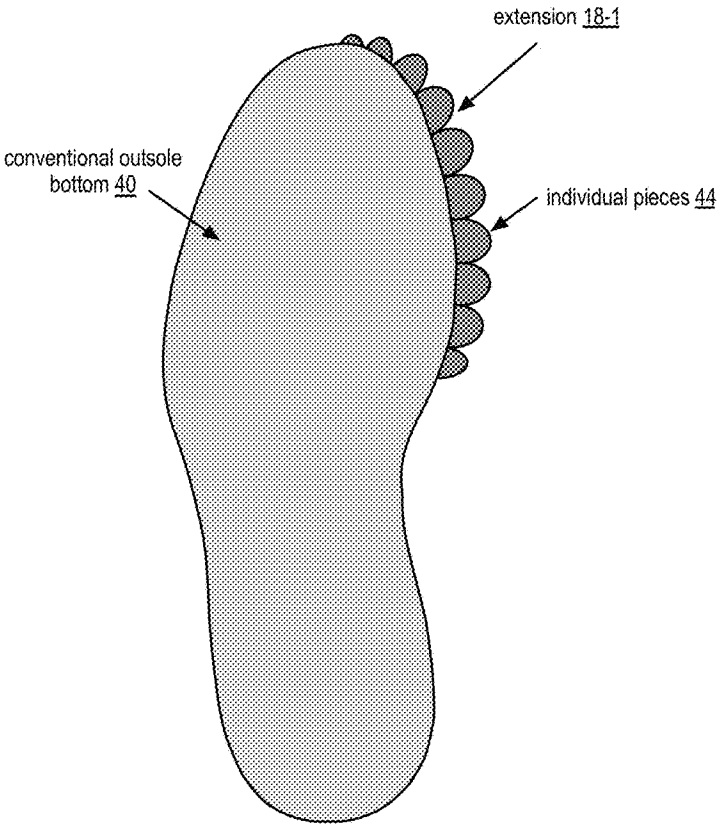
FIG. 7 is a bottom view of another embodiment of a right foot athletic shoe in accordance with the present invention.

FIG. 7 is a bottom view of another embodiment of a right-footed athletic shoe 10-1 that includes extension 18-1. To illustrate an example length and width of the extension 18-1, a conventional shoe bottom 40 is shown with lighter shading. In this embodiment, the extension 18-1 includes a series of individual pieces 44. Each individual piece 44 may be of the same shape (e.g., partial circles, partial ellipses, partial ovals, partial hexagons, partial octagons, etc.), of different shapes, of the same material (e.g., foam, plastic, ethylene-vinyl acetate (EVA), rubber, polyurethane (PU), plastic, thermoplastic polyurethane (TPU), and/or a combination thereof), and/or of different materials.

Figure 8:
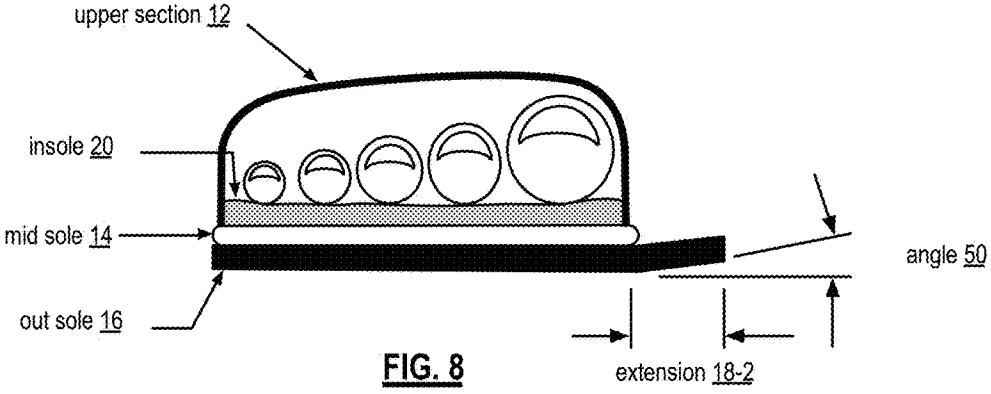
FIG. 8 is a cross-section front view of another embodiment of a right foot athletic shoe in accordance with the present invention.

FIG. 8 is a cross-section front view of another embodiment of a right-footed athletic shoe 10 that includes the upper section 12, the midsole 14, the outsole 16, an extension 18-2, and an insole 20. The extension 18-2 is integrated into the outsole 16 and includes an upward angle 50 in the range of less than a degree to fifteen degrees. With the upward angle 50, the effective mass may be slightly less than an un-angled extension 18, which allows for an easier pivoting of the dominant leg foot during performance of the athletic task.

Figure 9:
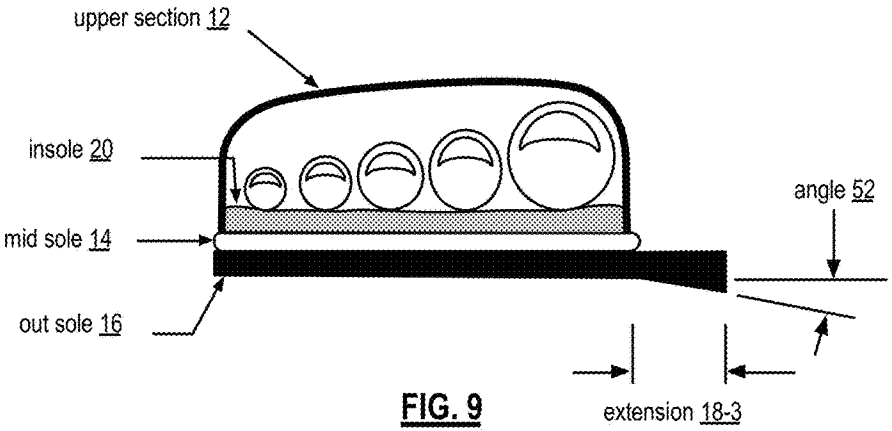
FIG. 9 is a cross-section front view of another embodiment of a right foot athletic shoe in accordance with the present invention.

FIG. 9 is a cross-section front view of another embodiment of a right-footed athletic shoe 10 that includes the upper section 12, the midsole 14, the outsole 16, an extension 18-3, and an insole 20. The extension 18-3 is integrated into the outsole 16 and includes a downward angle 52 in the range of less than a degree to fifteen degrees. With the downward angle 52, the effective mass is slightly increased with respect to an un-angled extension 18, which further increases the force.

Figure 10:
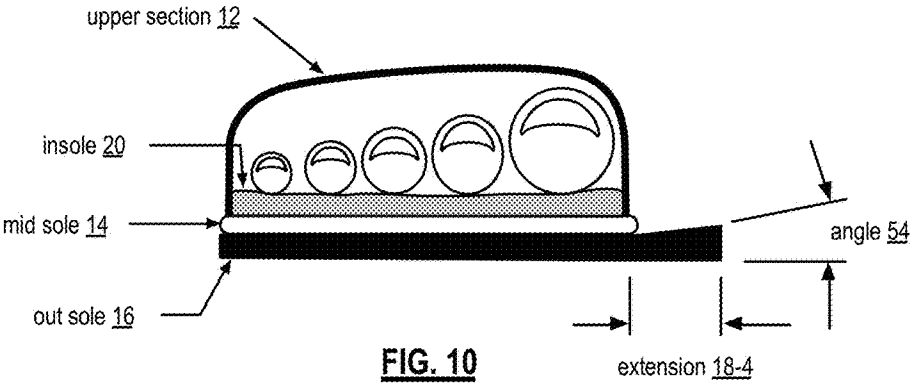
FIG. 10 is a cross-section front view of another embodiment of a right foot athletic shoe in accordance with the present invention.

FIG. 10 is a cross-section front view of another embodiment of a right-footed athletic shoe 10 that includes the upper section 12, the midsole 14, the outsole 16, an extension 18-4, and an insole 20. The extension 18-4 is integrated into the outsole 16 and includes an upward angled section 54 in the range of less than a degree to fifteen degrees. With the upward angle section 54, the extension 18-4 is more rigid, which increases the effective mass in comparison to an un-angled extension 18. This increases the force in performance of the athletic task.

Figure 11:
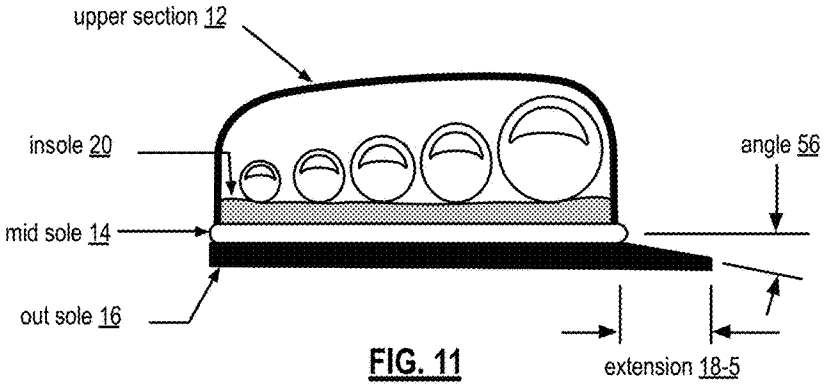
FIG. 11 is a cross-section front view of another embodiment of a right foot athletic shoe in accordance with the present invention.

FIG. 11 is a cross-section front view of another embodiment of a right-footed athletic shoe 10 that includes the upper section 12, the midsole 14, the outsole 16, an extension 18-5, and an insole 20. The extension 18-5 is integrated into the outsole 16 and includes a downward angled section 56 in the range of less than a degree to fifteen degrees to increase flexibility of the extension 18-5. With the downward angled section 56, the effective mass may be slightly less than an un-angled extension 18, which allows for an easier pivoting of the dominant leg foot during performance of the athletic task.

Figure 12:
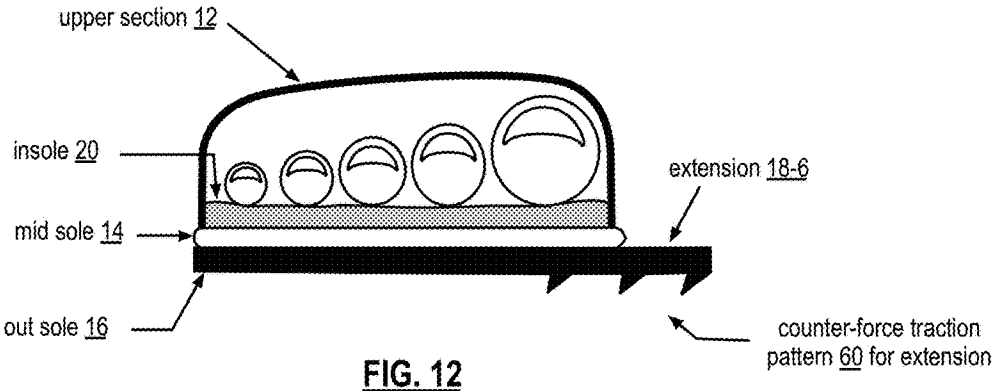
FIG. 12 is a cross-section front view of another embodiment of a right foot athletic shoe in accordance with the present invention.

FIG. 12 is a cross-section front view of another embodiment of a right-footed athletic shoe 10 that includes the upper section 12, the midsole 14, the outsole 16, an extension 18-5, and an insole 20. The extension 18-6 is integrated into the outsole 16 and includes a traction pattern 60. The traction pattern 60 includes a pattern of cleats to resist backward lateral movement (e.g., shifting the weight outside of the right knee for a right-handed athlete) of a forefoot of the athletic shoe 10. The cleats may be formed into the extension 18-6 and composed on the same material as the extension 18-6. Alternatively, or in addition, the cleats may be removable cleats that mate with cleat receptacles within the extension 18-6. For example, the mating may be screwing, clipping, clasping, twist and lock, etc.

The size, shape, and pattern of the cleats may vary. For example, in one pattern of cleats, the cleats have an inverted conical shape of the same size arranged in a linear, curved, and/or other pattern. In another example of a pattern of cleats, the cleats have a cross-sectional right angle shape of the same sized arranged in a linear, curved, and/or other pattern. In yet another example of a pattern of cleats, the cleats are of different shapes and/or different sizes arranged in a linear, curved, and/or other pattern.

Figure 13:
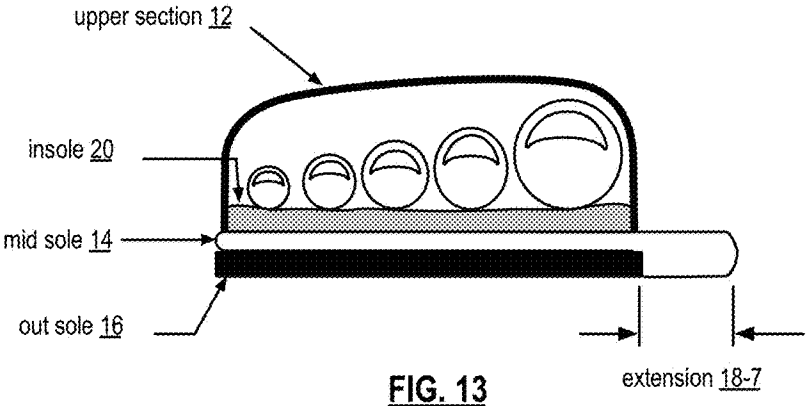
FIG. 13 is a cross-section front view of another embodiment of a right foot athletic shoe in accordance with the present invention.
Figure 14:
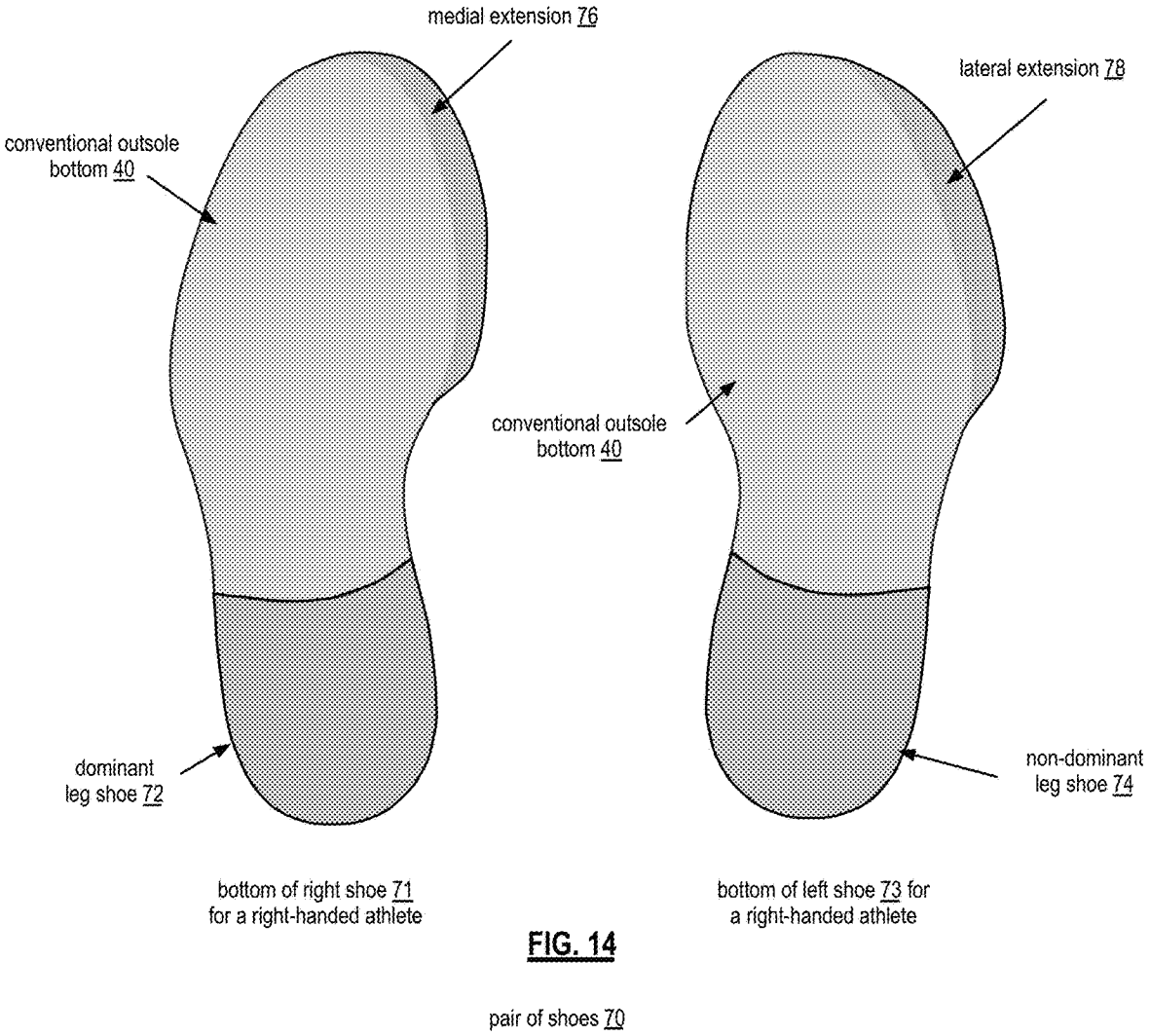
FIG. 14 is a bottom view of an embodiment of a pair of athletic shoes in accordance with the present invention.
Figure 16:
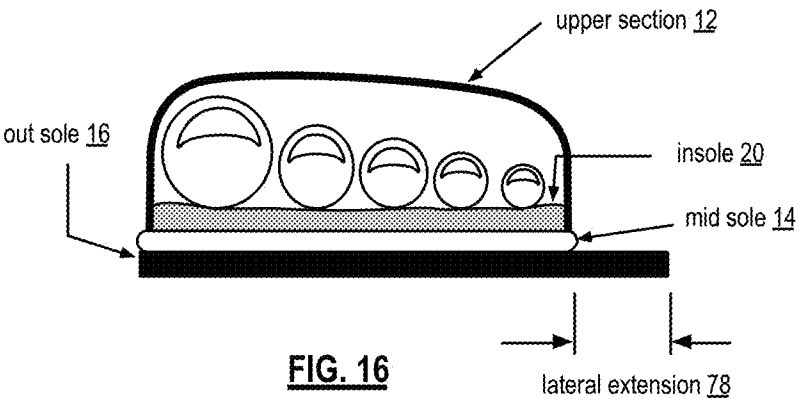
FIG. 16 is a cross-section front view of an embodiment of a left foot athletic shoe in accordance with the present invention.
Figure 15:
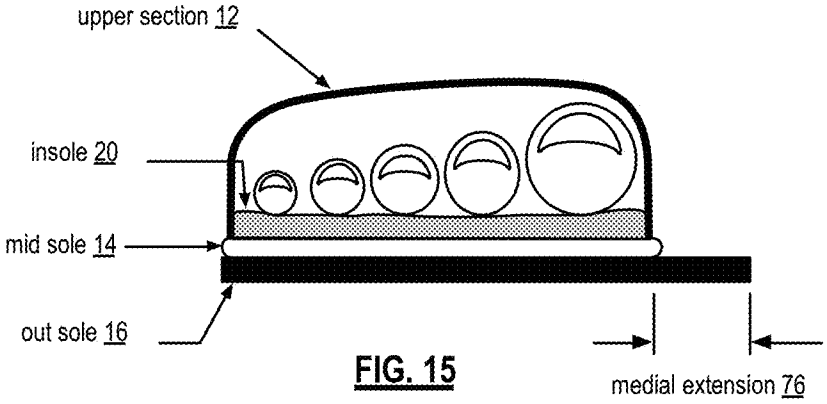
FIG. 15 is a cross-section front view of an embodiment of a right foot athletic shoe in accordance with the present invention.
Figure 17:
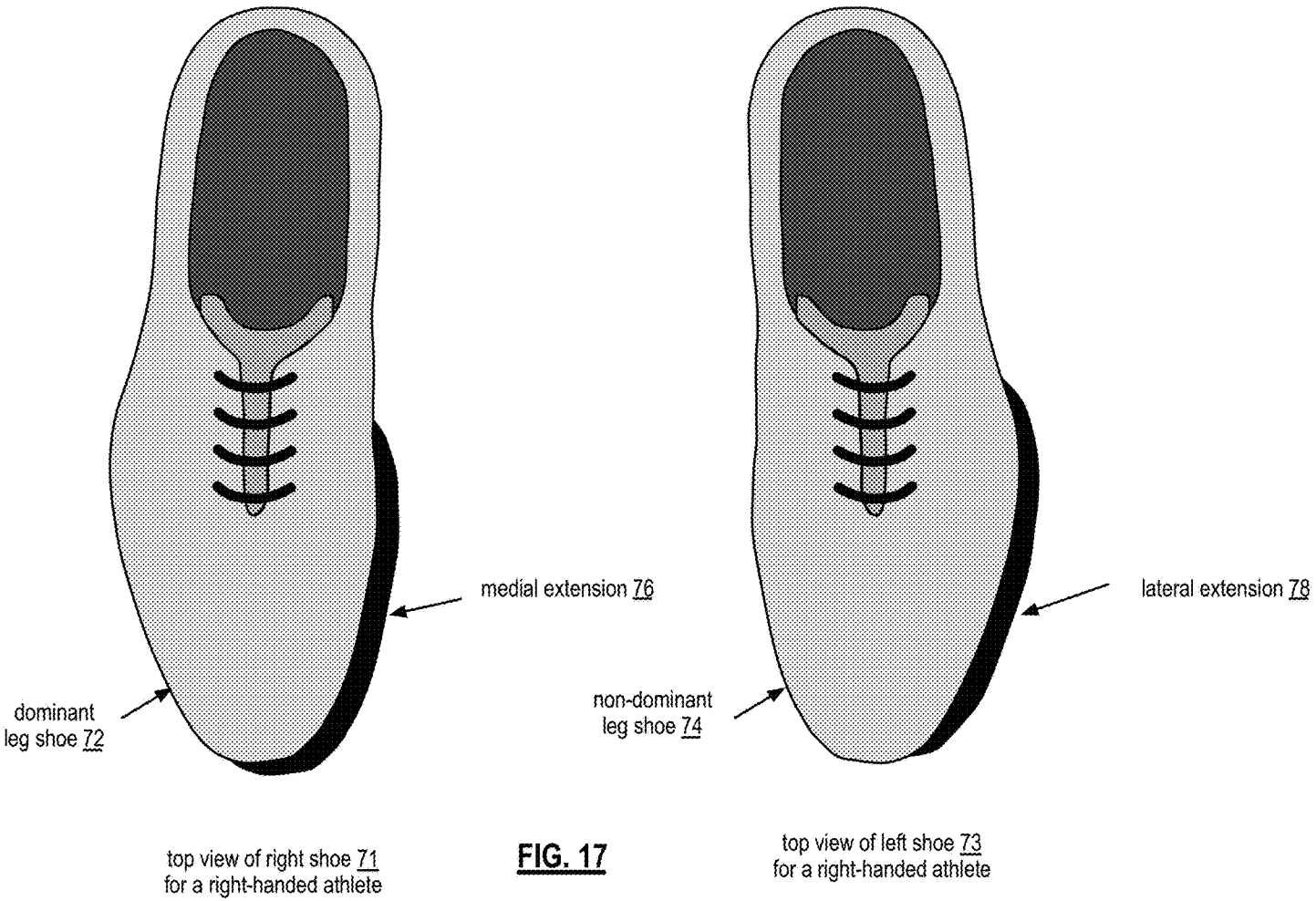
FIG. 17 is a top view of an embodiment of a pair of athletic shoes in accordance with the present invention.

FIG. 13 is a cross-section front view of another embodiment of a right-footed athletic shoe 10 that includes the upper section 12, the midsole 14, the outsole 16, an extension 18-7, and an insole 20. The extension 18-7 is integrated into the midsole 14. The extension 18-7 may be composed of the same material as the midsole 14 or one or more different materials (e.g., foam, plastic, ethylene-vinyl acetate (EVA), rubber, polyurethane (PU), plastic, thermoplastic polyurethane (TPU), and/or a combination thereof). The extension 18-7 may be shaped in accordance with one or more of the shapes discussed above.

FIGS. 14-17 are, respectively, a bottom view, front views, and a top view of an embodiment of a pair of athletic shoes 70 (e.g., golf shoes, baseball shoes, track and field shoes, etc.) that includes, for a right-handed athlete, a right shoe 71 and a left shoe 73. The right shoe 71, which is the dominant leg shoe for a right-handed athlete, includes the upper section 12, the midsole 14, the outsole 16, a medial side extension 76, and the insole 20. The left shoe 73, which is the non-dominant leg shoe for a right-handed athlete, includes the upper section 12, the midsole 14, the outsole 16, a lateral side extension 78, and the insole 20. Note that for a left-handed athlete, the left foot is the dominant leg foot and the right foot is the non-dominant leg foot. As such, for a left-handed athlete, the medial side extension 76 would be on the left shoe and the lateral side extension 78 would be on the right shoe. The remainder of the discussion of these figures will be with respect to a right-handed athlete.

On the right shoe 71, the medial side extension 76 is integrated into the dominant side outsole 16 and/or the dominant side midsole 14 and extends from a toe section of the right shoe 71 to a mid-foot section of the right shoe 71. From a top perspective, the medial side extension 76 extends beyond the dominant side upper section such that the medial side extension 76 provides an increase in force during performance of a rotational athletic task.

The medial side extension 76 may be constructed of the same material as the outsole 16 and/or the insole 20 or one or more different materials. In an embodiment, the medial side extension 76 extends, from the top perspective, beyond the dominant side upper section 12 by a few millimeters to 10 or more millimeters. In addition, or in an alternative embodiment, the medial side extension 76 includes a first traction pattern to resist backward lateral movement of the forefoot of the right shoe 71.

On the left shoe 73, the lateral side extension 78 is integrated into the non-dominant side out-sole 16 and/or the non-dominant side mid-sole 14. The lateral side extension 78 extends from a toe section of the left shoe 73 to a mid-foot section of the left shoe 73. From a top perspective, the lateral side extension 78 extends beyond the non-dominant side upper section 12 to provide an increase in force during performance of a rotational athletic task by increasing effective mass of the athlete during weight transfer from the dominant leg to the non-dominant leg (e.g., from the right leg to the left leg for a right-handed athlete).

The lateral side extension 78 may be constructed of the same material as the outsole 16 and/or the insole 20 or one or more different materials. In an embodiment, the lateral side extension 78 extends, from the top perspective, beyond the upper section 12 by a few millimeters to 10 or more millimeters.

In addition, or in an alternative embodiment, the lateral side extension 78 includes a second traction pattern of cleats to resist forward lateral movement of a forefoot of the left shoe 73 (e.g., resist the body weight shifting to outside of the left knee). The cleats may be formed into the extension 78 and composed on the same material as the extension 78. Alternatively, or in addition, the cleats may be removable cleats that mate with cleat receptacles within the extension 78. For example, the mating may be screwing, clipping, clasping, twist and lock, etc.

The size, shape, and pattern of the cleats may vary. For example, in one pattern of cleats, the cleats have an inverted conical shape of the same size arranged in a linear, curved, and/or other pattern. In another example of a pattern of cleats, the cleats have a cross-sectional right angle shape of the same sized arranged in a linear, curved, and/or other pattern. In yet another example of a pattern of cleats, the cleats are of different shapes and/or different sizes arranged in a linear, curved, and/or other pattern.

In one or more other embodiments, the medial side extension 76 and/or the lateral side extension 78 includes an upward angle in the range of less than a degree to fifteen degrees. Example of an upward angle were shown and discussed with reference to FIGS. 8 and 10.

In one or more other embodiments, the medial side extension 76 and/or the lateral side extension 78 includes a downward angle in the range of less than a degree to fifteen degrees. Example of a downward angle were shown and discussed with reference to FIGS. 9 and 11.

In one or more other embodiments, the medial side extension 76 and/or the lateral side extension 78 includes a contiguous piece and/or a series of individual pieces. For example, both extensions 76 and 78 may be contiguous pieces. As another example, the medial side extension 76 may be a contiguous piece and the lateral side extension 78 may be a series of individual pieces.

Figure 18:
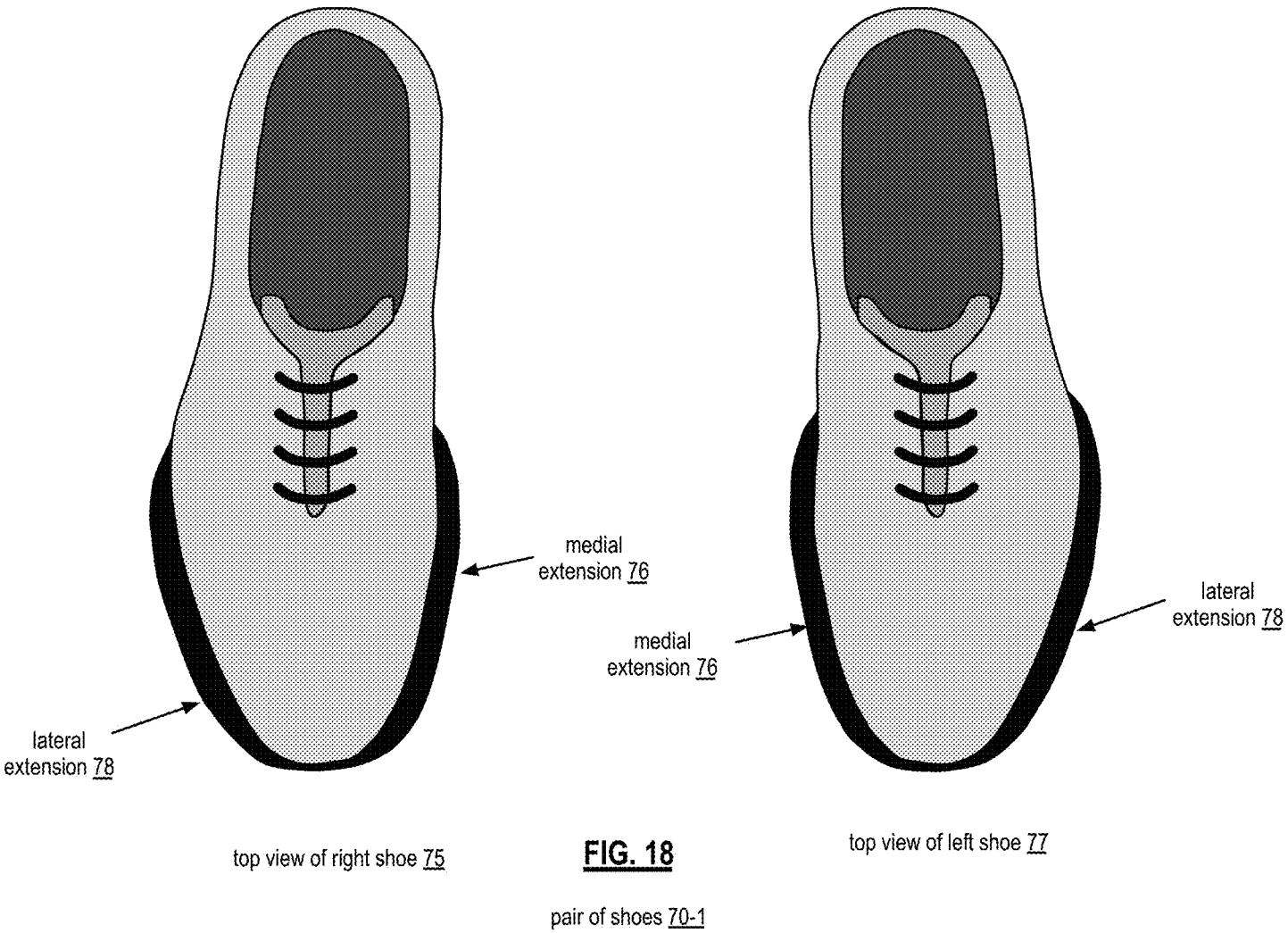
FIG. 18 is a top view of another embodiment of a pair of athletic shoes in accordance with the present invention.

FIG. 18 is a top view of another embodiment of a pair of athletic shoes 70-1 that includes a right shoe 75 and left shoe 77. Each of the right and left shoes 75 and 77 includes the upper section 12, the midsole 14, the outsole 16, a medial side extension 76, the lateral side extension 78, and the insole 20. Left-handed and/or right-handed athletes may wear the pair of shoes 70-1 to increase power during performance of a rotational athletic task (e.g., a golf swing, hitting a baseball, throwing a baseball, throwing a discus, etc.).

Figure 20:
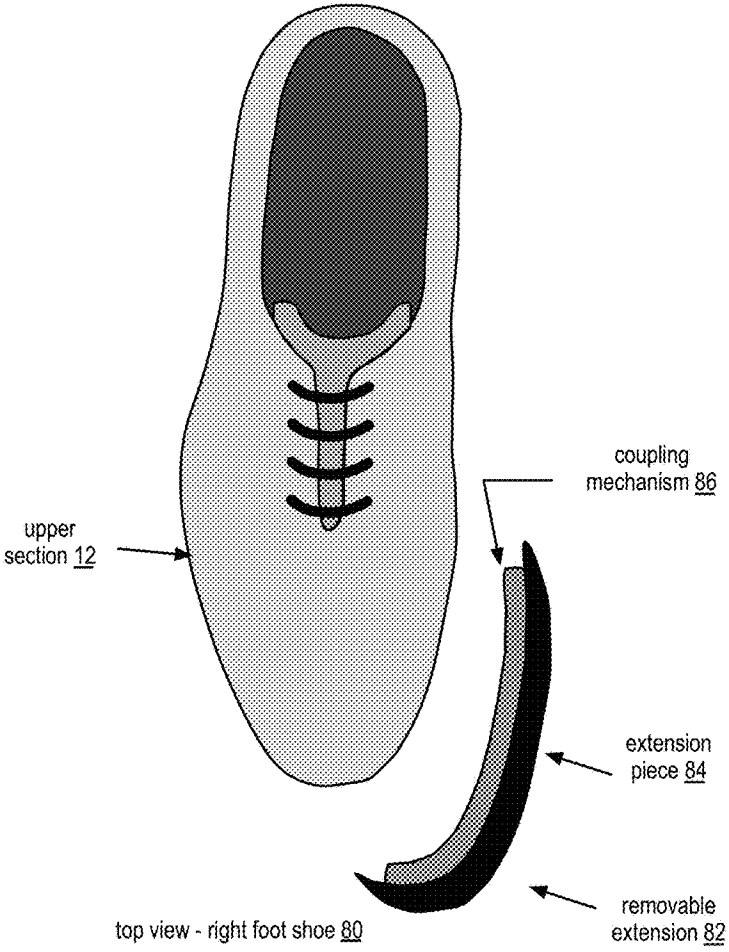
FIG. 20 is a top view of another embodiment of a right foot athletic shoe in accordance with the present invention.
Figure 19:
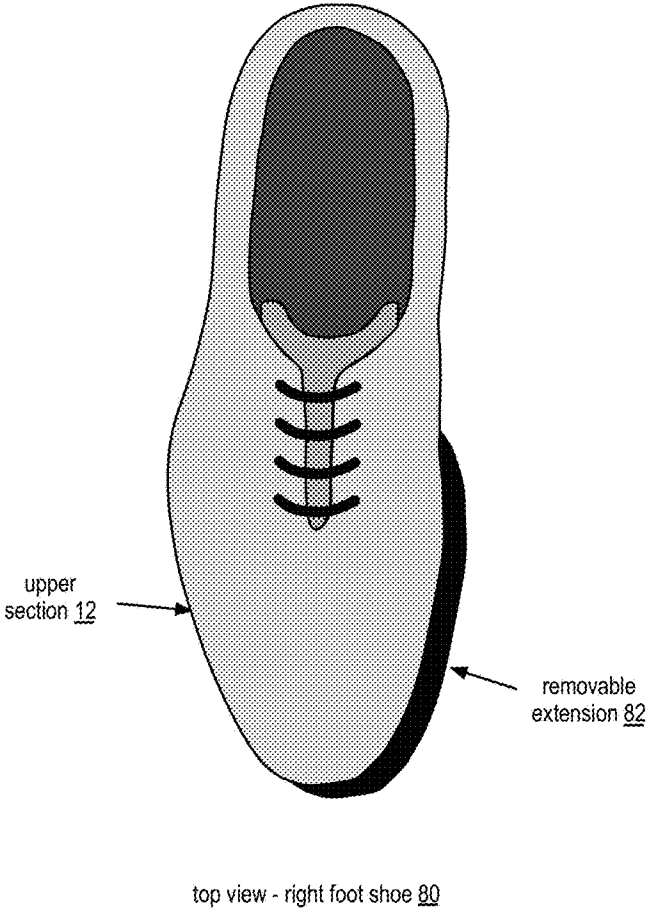
FIG. 19 is a top view of another embodiment of a right foot athletic shoe in accordance with the present invention.
Figure 21:
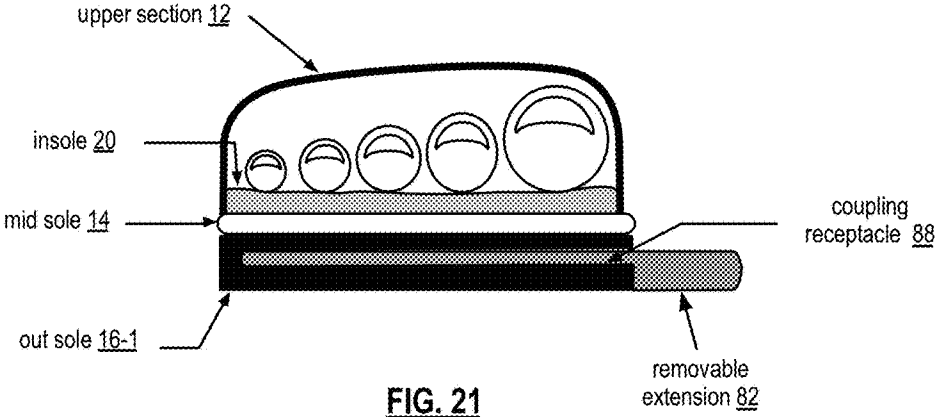
FIG. 21 is a front view of another embodiment of a right foot athletic shoe in accordance with the present invention.
Figure 22:
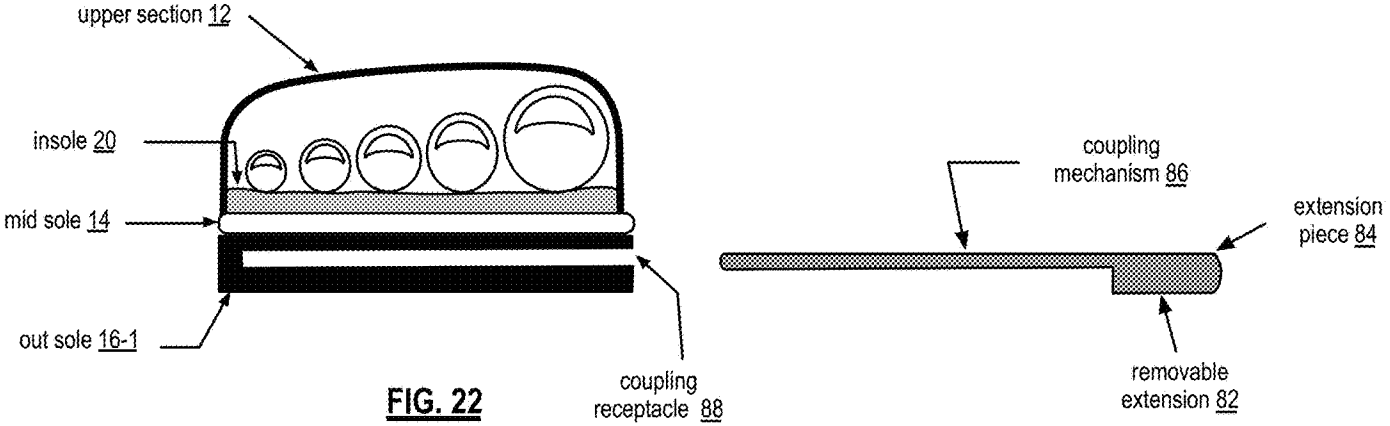
FIG. 22 is a front view of another embodiment of a right foot athletic shoe in accordance with the present invention.

FIGS. 19 and 20 are top views and FIGS. 21 and 22 are front views of another embodiment of a right foot athletic shoe 80 that includes the upper section 12 and a removable extension 82. The right foot athletic shoe 80 further includes a midsole 14, an insole 20, and an outsole 16-1, which includes a coupling receptacle 88. The removable extension 82 includes an extension piece 84 and a coupling mechanism 86. The extension piece 84 may have a shape and material composition as previously described with reference to one or more of extensions 18 through 18-7.

The removable extension 82 couples to the outsole 16-1 of the shoe 80 via the coupling mechanism 86 mating with the coupling receptacle 88. Accordingly, the coupling receptacle 88 corresponds to the coupling mechanism 86. For example, if the coupling mechanism 86 is a push connector and then the coupling receptacle 88 is a push receptacle. As another example, if the coupling mechanism 86 is a twist and lock connector and then the coupling receptacle 88 is a twist and lock receptacle. As one of ordinary skill in the art will appreciate, there are a wide variety of coupling mechanisms 86 and coupling receptacles 88 that can be used to secure the removable extension 82 couples to the outsole 16-1.

Figure 23:
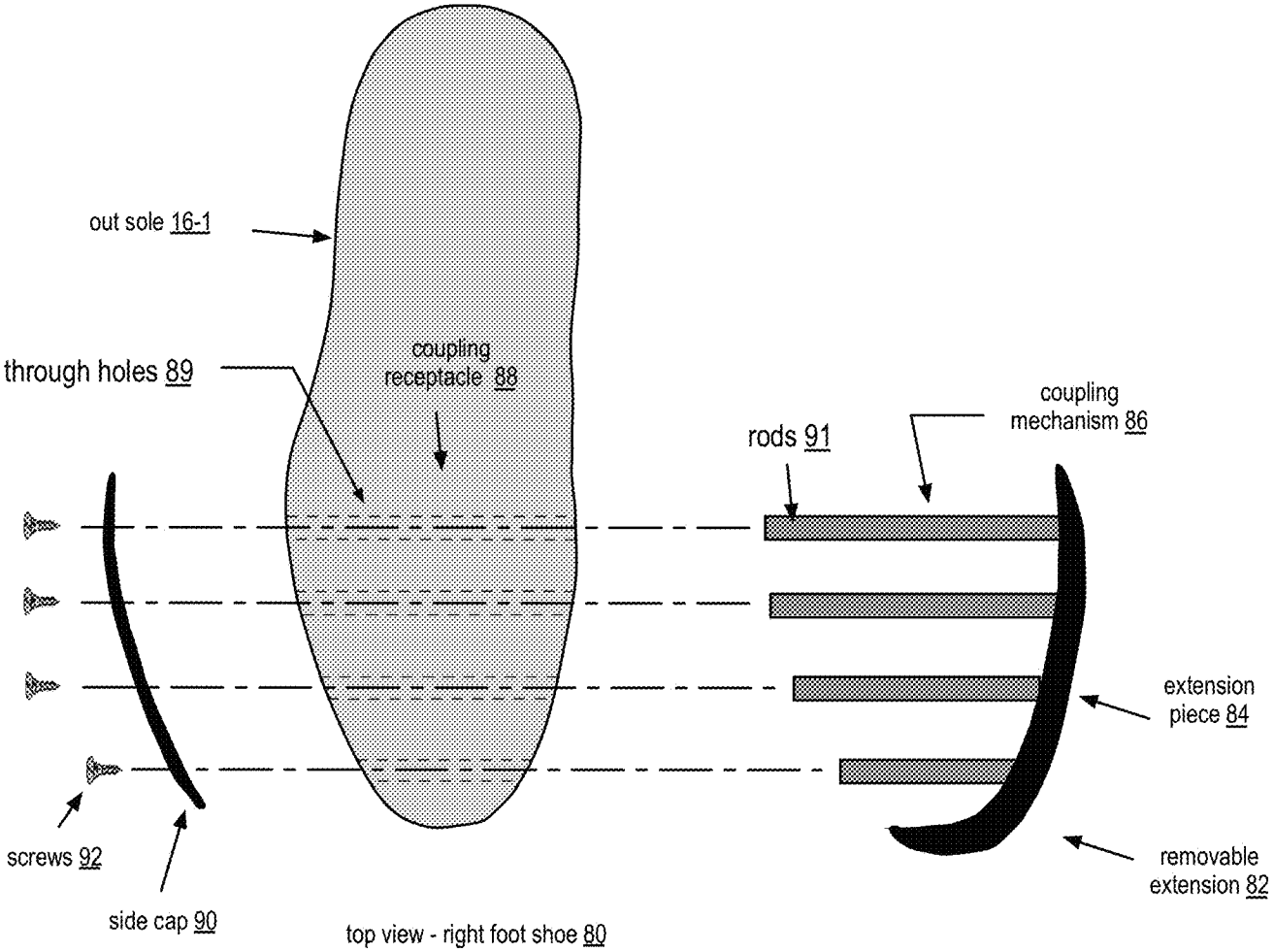
FIG. 23 is a top view of an embodiment an outsole of a right foot athletic shoe in accordance with the present invention.

FIG. 23 is a top view of an example embodiment an outsole 16-1 and the removable extension 82 of the right foot athletic shoe 80. In this example, the outsole 16-1 includes a plurality of through holes 89 in the forefoot section to provide the coupling receptacle 88. The coupling mechanism 86 of the removable extension 82 includes a plurality of rods 91, a side cap 90, and a plurality of screws 92. Each of the rods 91 may be a tube and/or a solid rod that is attached, molded, and/or otherwise mechanically connected to the extension piece 84 and is tapped at one end to receive one of the screws 92. The rods 91 may be plastic, metal, rubber, and/or any other rigid material and have a diameter of a $1/16^{th}$ of an inch to about ¼ of an inch.

The through holes 89 may be spaced about ¼ inch apart to about 1 inch apart and have an inner diameter slightly larger than the outer diameter of the rods 91. To secure the removable extension 82 to the outsole 16-1, the rods 91 are inserted into the through holes 89 until the extension piece 84 butts up against the medial edge of the forefoot of the outsole 16-1. The side cap 90, which includes holes, is aligned with the rods 91 such that, as the screws 92 are tightened, the removable extension 82 is secured to the outsole 16-1.

The outsole 16-1 may include a recessed area on the lateral side of the forefoot for receiving the side cap 90 to provide an aligning mechanism and/or to ensure that the side cap 90 does not extend beyond the outsole 16-1 (from a top perspective). As an alternative, the side cap 90 may be replaced with a lateral side removable extension that includes holes for accepting the screws 92.

Note that the rods 91 and the through holes 89 may have a cross-section geometry beyond that of a circle. For example, the rods 91 and the through holes 89 may have an oval or elliptical cross-section shape; a triangular cross-section shape; a square or rectangular cross-section shape; a star cross-section shape; a hexagon cross-section shape; and/or other polygonal cross-section shape.

In a further embodiment, the right foot athletic shoe 80 may include a plurality of removable extensions 82 of different sizes, shapes, and/or materials to provide different levels of enhancements of an athletic task. For example, one removable extension 82 has a width of 5 mm, a second one has a width of 10 mm, and a third one has a width of 15 mm. As another example, one removable extension 82 has a shape as shown in FIG. 8, a second one has a shape as shown in FIG. 9, a third one has a shape as shown in FIG. 10, a fourth one has a shape as shown in FIG. 11, and a fifth one has a shape as shown in FIG. 12.

As may be used herein, the terms "substantially" and "approximately" provides an industry-accepted tolerance for its corresponding term and/or relativity between items. Such an industry-accepted tolerance ranges from less than one percent to fifty percent and corresponds to, but is not limited to, component values, integrated circuit process variations, temperature variations, rise and fall times, and/or thermal noise. Such relativity between items ranges from a difference of a few percent to magnitude differences. As may also be used herein, the term(s) "configured to", "operably coupled to", "coupled to", and/or "coupling" includes direct coupling between items and/or indirect coupling between items via an intervening item (e.g., an item includes, but is not limited to, a component, an element, a circuit, and/or a module) where, for an example of indirect coupling, the intervening item does not modify the information of a signal but may adjust its current level, voltage level, and/or power level. As may further be used herein, inferred coupling (i.e., where one element is coupled to another element by inference) includes direct and indirect coupling between two items in the same manner as "coupled to". As may even further be used herein, the term "configured to", "operable to", "coupled to", or "operably coupled to" indicates that an item includes one or more of power connections, input(s), output(s), etc., to perform, when activated, one or more its corresponding functions and may further include inferred coupling to one or more other items. As may still further be used herein, the term "associated with", includes direct and/or indirect coupling of separate items and/or one item being embedded within another item.

As may be used herein, the term "compares favorably", indicates that a comparison between two or more items, signals, etc., provides a desired relationship. For example, when the desired relationship is that signal 1 has a greater magnitude than signal 2, a favorable comparison may be achieved when the magnitude of signal 1 is greater than that of signal 2 or when the magnitude of signal 2 is less than that of signal 1. As may be used herein, the term "compares unfavorably", indicates that a comparison between two or more items, signals, etc., fails to provide the desired relationship.

One or more embodiments have been described above with the aid of method steps illustrating the performance of specified functions and relationships thereof. The boundaries and sequence of these functional building blocks and method steps have been arbitrarily defined herein for convenience of description. Alternate boundaries and sequences can be defined so long as the specified functions and relationships are appropriately performed. Any such alternate boundaries or sequences are thus within the scope and spirit of the claims. Further, the boundaries of these functional building blocks have been arbitrarily defined for convenience of description. Alternate boundaries could be defined as long as the certain significant functions are appropriately performed. Similarly, flow diagram blocks may also have been arbitrarily defined herein to illustrate certain significant functionality.

To the extent used, the flow diagram block boundaries and sequence could have been defined otherwise and still perform the certain significant functionality. Such alternate definitions of both functional building blocks and flow diagram blocks and sequences are thus within the scope and spirit of the claims. One of average skill in the art will also recognize that the functional building blocks, and other illustrative blocks, modules and components herein, can be implemented as illustrated or by discrete components, application specific integrated circuits, processors executing appropriate software and the like or any combination thereof.

In addition, a flow diagram may include a "start" and/or "continue" indication. The "start" and "continue" indications reflect that the steps presented can optionally be incorporated in or otherwise used in conjunction with other routines. In this context, "start" indicates the beginning of the first step presented and may be preceded by other activities not specifically shown. Further, the "continue" indication reflects that the steps presented may be performed multiple times and/or may be succeeded by other activities not specifically shown. Further, while a flow diagram indicates a particular ordering of steps, other orderings are likewise possible provided that the principles of causality are maintained.

The one or more embodiments are used herein to illustrate one or more aspects, one or more features, one or more concepts, and/or one or more examples. A physical embodiment of an apparatus, an article of manufacture, a machine, and/or of a process may include one or more of the aspects, features, concepts, examples, etc. described with reference to one or more of the embodiments discussed herein. Further, from figure to figure, the embodiments may incorporate the same or similarly named functions, steps, modules, etc. that may use the same or different reference numbers and, as such, the functions, steps, modules, etc. may be the same or similar functions, steps, modules, etc. or different ones.

Unless specifically stated to the contra, signals to, from, and/or between elements in a figure of any of the figures presented herein may be analog or digital, continuous time or discrete time, and single-ended or differential. For instance, if a signal path is shown as a single-ended path, it also represents a differential signal path. Similarly, if a signal path is shown as a differential path, it also represents a single-ended signal path. While one or more particular architectures are described herein, other architectures can likewise be implemented that use one or more data buses not expressly shown, direct connectivity between elements, and/or indirect coupling between other elements as recognized by one of average skill in the art.

While particular combinations of various functions and features of the one or more embodiments have been expressly described herein, other combinations of these features and functions are likewise possible. The present disclosure is not limited by the particular examples disclosed herein and expressly incorporates these other combinations.

What is claimed is:

1. A dominant side athletic shoe comprises: an upper section; a mid-sole coupled to the upper section; and an out-sole coupled to the mid-sole, wherein at least one of the mid-sole and the out-sole includes an extension on a medial side of the dominant side athletic shoe, wherein the extension has a width, wherein the extension has a length that extends from a toe section of the dominant side athletic shoe to a mid-foot section of the dominant side athletic shoe and extends, from a top perspective, beyond the upper section by at least the width to provide an increase in force during performance of a rotational athletic task;

wherein said extension is contiguous piece integrated into said outsole; wherein the extension comprises: an upward angle in the range of less than a degree to fifteen degrees.

2. The dominant side athletic shoe of claim 1 further comprises:

the width of the extension is at least ten millimeters.

3. The dominant side athletic shoe of claim 1 further comprises:

a golf shoe, wherein the rotational athletic task includes a golf swing.

4. The dominant side athletic shoe of claim 1 further comprises:

a baseball shoe, wherein the rotational athletic task includes swinging a baseball bat or throwing a baseball.

5. The dominant side athletic shoe of claim 1 further comprises:

the extension integrated into the mid-sole.

6. The dominant side athletic shoe of claim 1, wherein the extension comprises:

a traction pattern of cleats having a pattern to resist backward lateral movement of a forefoot of the dominant side athletic shoe.

7. The dominant side athletic shoe of claim 1, wherein the extension comprises:

a downward angle in the range of less than a degree to fifteen degrees.

8. The dominant side athletic shoe of claim 1, wherein the extension comprises:

a series of individual pieces.

9. A pair of athletic shoes comprises:

a dominant side shoe that includes: a dominant side upper section;

a dominant side mid-sole coupled to the dominant side upper section; a dominant side out-sole coupled to the dominant side upper section and the dominant side mid-sole, wherein at least one of dominant side mid-sole and the dominant side out-sole includes a dominant side extension on a medial side of the dominant side shoe, wherein the dominant side extension has a first width, wherein the dominant side extension has a first length that extends from a toe section of the dominant side shoe to a mid-foot section of the dominant side shoe and extends, from a top perspective, beyond the dominant side upper section by at least the first width to provide an increase in force during performance of a rotational athletic task; and a non-dominant leg shoe that includes: a non-dominant side upper section;

a non-dominant side mid-sole coupled to the non-dominant side upper section; a non-dominant side out-sole coupled to the mid-sole, wherein the non-dominant out-sole includes a non-dominant side extension on a lateral side of the non-dominant side shoe, wherein the non-dominant side extension has a second width, wherein the non-dominant side extension has a second length that extends from a toe section of the non-dominant side shoe to a mid-foot section of the non-dominant side shoe and extends, from a top perspective, beyond the non-dominant side upper section by at least the second width to provide an increase in force during performance of a rotational athletic task;

wherein said extension is contiguous piece integrated into said outsole;

wherein the extension comprises: an upward angle in the range of less than a degree to fifteen degrees.

10. The pair of athletic shoes of claim 9 further comprises:

the first width is at least ten millimeters; and the second width is at least ten millimeters.

11. The pair of athletic shoes of claim 9 further comprises:

a pair of golf shoes, wherein the rotational athletic task includes a golf swing.

12. The pair of athletic shoes of claim 9 further comprises:

a pair of baseball shoes, wherein the rotational athletic task includes swinging a baseball bat or throwing a baseball.

13. The pair of athletic shoes of claim 9 further comprises:

the dominant side extension is integrated into the dominant side mid-sole; and the non-dominant side extension is integrated into the non-dominant side mid-sole.

14. The pair of athletic shoes of claim 9 further comprises:

the dominant side extension includes a first traction pattern of cleats to resist backward lateral movement of a forefoot of the dominant side shoe; and the non-dominant side extension includes a second traction pattern of cleats to resist forward lateral movement of a forefoot of the non-dominant side shoe.

15. The pair of athletic shoes of claim 9, wherein at least one of the dominant side extension and the non-dominant side extension comprises:

a downward angle in the range of less than a degree to fifteen degrees.

16. The pair of athletic shoes of claim 9, wherein at least one of the dominant side extension and the non-dominant side extension comprises:

a series of individual pieces.

* * * * *